US008974245B2

(12) United States Patent
Kovalov

(10) Patent No.: US 8,974,245 B2
(45) Date of Patent: Mar. 10, 2015

(54) GROUNDING ELECTRICAL CONNECTOR

(71) Applicant: Hubbell Incorporated, Shelton, CT (US)

(72) Inventor: Paul Kovalov, Manchester, NH (US)

(73) Assignee: Hubbell Incorporated, Shelton, CT (US)

( * ) Notice: Subject to any disclaimer, the term of this patent is extended or adjusted under 35 U.S.C. 154(b) by 39 days.

(21) Appl. No.: 13/959,048

(22) Filed: Aug. 5, 2013

(65) Prior Publication Data

US 2015/0034362 A1 Feb. 5, 2015

(51) Int. Cl.
*H01R 4/24* (2006.01)
*H01R 27/02* (2006.01)

(52) U.S. Cl.
CPC ..... *H01R 27/02* (2013.01)
USPC ..... 439/397; 439/100

(58) Field of Classification Search
USPC ..... 439/397, 403, 100, 92, 408
See application file for complete search history.

(56) References Cited

U.S. PATENT DOCUMENTS

| | | | | |
|---|---|---|---|---|
| 3,405,385 | A * | 10/1968 | Rapp | 439/397 |
| 4,029,384 | A * | 6/1977 | Reinwall, Jr. | 439/397 |
| 4,527,857 | A * | 7/1985 | Hughes et al. | 439/849 |
| 4,904,203 | A | 2/1990 | Wang | |
| 5,358,423 | A * | 10/1994 | Burkhard et al. | 439/402 |
| 5,451,167 | A * | 9/1995 | Zielinski et al. | 439/92 |
| 6,086,405 | A * | 7/2000 | Liebich | 439/397 |
| 6,086,408 | A * | 7/2000 | Tanigawa | 439/419 |
| 6,106,310 | A * | 8/2000 | Davis et al. | 439/95 |
| 6,135,804 | A * | 10/2000 | Lux | 439/397 |
| 6,203,360 | B1 | 3/2001 | Harting | |
| 6,280,230 | B1 * | 8/2001 | Takase et al. | 439/397 |
| 6,312,288 | B1 * | 11/2001 | Genz et al. | 439/628 |
| 6,325,659 | B1 | 12/2001 | Heinzen | |
| 6,692,290 | B2 * | 2/2004 | Yamanashi et al. | 439/397 |
| 7,056,146 | B2 * | 6/2006 | Hiramoto et al. | 439/397 |
| 7,163,415 | B2 | 1/2007 | Miyoshi | |
| 7,326,069 | B1 | 2/2008 | Duesterhoeft | |
| 7,354,295 | B2 | 4/2008 | Tashiro | |
| D606,025 | S | 12/2009 | Cheng | |
| 7,938,673 | B2 | 5/2011 | Hetzer | |
| 8,267,715 | B2 | 9/2012 | Roosdorp | |
| 2007/0254521 | A1 | 11/2007 | D'Agostini | |
| 2007/0259558 | A1 * | 11/2007 | Cheng | 439/397 |
| 2012/0149233 | A1 | 6/2012 | Hsueh | |
| 2012/0192925 | A1 | 8/2012 | Grushkowitz | |
| 2012/0270432 | A1 | 10/2012 | Jaeckle | |
| 2013/0065424 | A1 | 3/2013 | Parrish | |

FOREIGN PATENT DOCUMENTS

| | | |
|---|---|---|
| EP | 0 383 135 B1 | 1/1995 |

* cited by examiner

*Primary Examiner* — Gary Paumen
(74) *Attorney, Agent, or Firm* — Roylance, Abrams, Berdo & Goodman, L.L.P.

(57) ABSTRACT

An electrical connector includes a base member and first and second legs extending outwardly from the base member. A first recess is defined by the first and second legs for receiving a support. Second recesses extend inwardly from second sides of the first and second legs. A plurality of pairs of oppositely disposed grooves are formed in the second recesses. At least two pairs of the oppositely disposed grooves have different sizes for receiving various conductor sizes.

20 Claims, 13 Drawing Sheets

FIG. 2
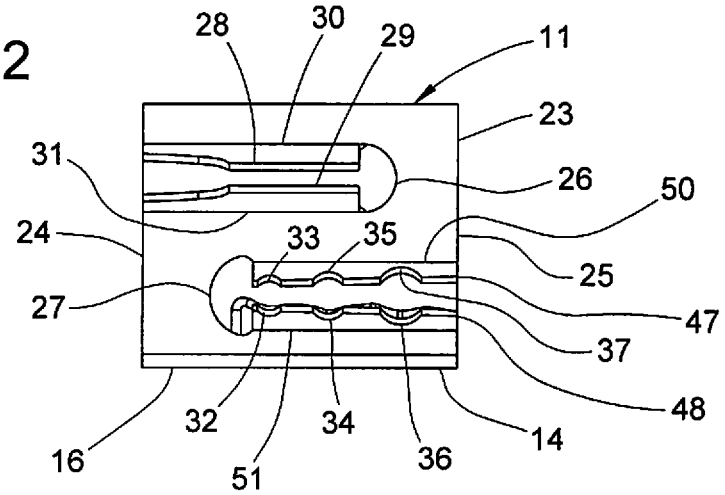
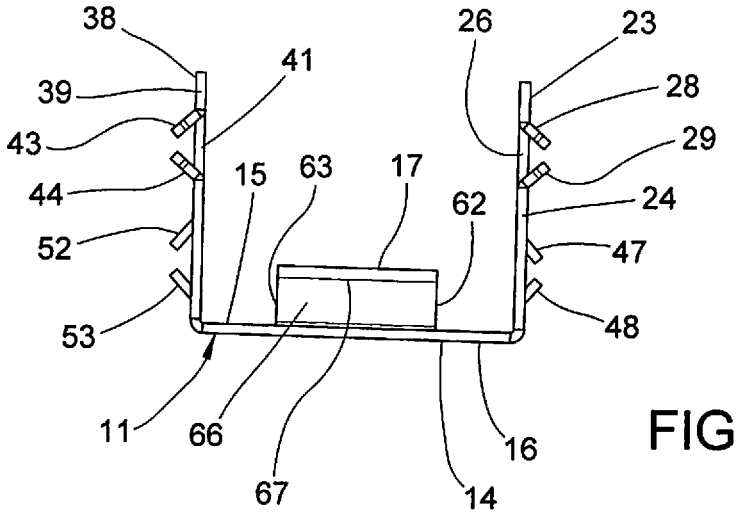
FIG. 3
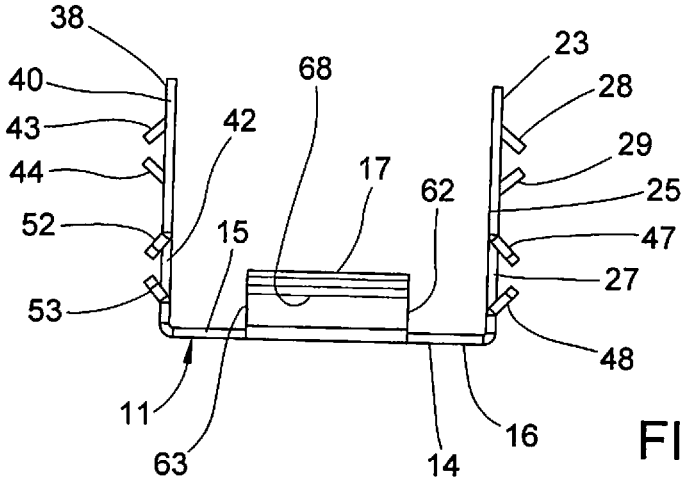
FIG. 4

211
272
214
271

226
223
214
227
211

214
211

272
238
242
214
274
211
278
273
271
277
223
227

271
226
223
214
273
211
275
274
276
272
241
238

211
238
242
274
273
214
241
277
278
226
272
276
271
223
227

311
314
372
371

311
326
314
323
327
379

311
374
338
314
380
373
379
323

314
311

311
373
323
314
379
375
374
376
380
338

311
341
374
338
342
380
373
379
314
326
381
372
376
371
327
323

326
323
314
327
379
375
373
380
374
376
342
338
311

GROUNDING ELECTRICAL CONNECTOR

FIELD OF THE INVENTION

The present invention relates generally to a grounding electrical connector. More particularly, the present invention relates to a toolless and hardwareless (i.e., without separate fasteners) grounding electrical connector that is connectable to a support. Still more particularly, the present invention relates to a grounding electrical connector that receives various conductor sizes and connects to various support thicknesses.

BACKGROUND OF THE INVENTION

Grounding electrical connectors, such as lay-in lugs, are typically used for installation of a ground conductor. A fastener opening in a first portion receives a fastener to secure the connector to a support. A second fastener opening receives a set screw that extends into an opening that receives the ground conductor. The set screw engages the received ground conductor to secure the ground conductor thereto.

One disadvantage associated with existing grounding electrical connectors is that connecting the grounding electrical connector to the support can be a time-consuming task. A corresponding fastener hole must be formed in the support such that it can receive the fastener. Supports typically have a non-conductive coating that must be removed prior to connecting the grounding electrical connector. An installer must have the proper tools to form the fastener hole in the support and remove the non-conductive coating, as well as carrying the proper fasteners to secure the grounding electrical connector to the support. Accordingly, a need exists for a grounding electrical connector that is quickly and easily connected to a support.

The installer must also emply another fastener, typically a set screw, that secures the ground conductor to the grounding electrical connector. The set screw can loosen over time, which can be accelerated by movement of the conductor, thereby adversely affecting the integrity of the ground connection. Some existing grounding electrical connectors are formed from several components, some of which are movable, thereby further increasing the number of parts that the installer must have on hand during installation. Accordingly, a need exists for a grounding electrical connector having few components that is simple to install.

Precise torques or tools are often required to properly install existing grounding electrical connectors and secure grounding conductors thereto. The necessary tools required for installation increases the inventory of necessary parts to be carried by the installer, as well as increasing the difficulty of the installation. Accordingly, a need exists for a toolless grounding electrical connector.

Existing grounding electrical connectors are expensive due to machining, plating and the use of copper. Accordingly, a need exists for an inexpensive grounding electrical connector that is easily manufactured.

SUMMARY OF THE INVENTION

An object of the present invention is to provide an improved grounding electrical connector.

Another object of the present invention is to provide a grounding electrical connector that is quickly and easily connected to a support.

Another object of the present invention is to provide a grounding electrical connector that is inexpensive, has few parts and is easily manufactured.

Another object of the present invention is to provide a grounding electrical connector that is toollessly and hardwarelessly connectable to a support.

Another object of the present invention is to provide a grounding electrical connector that toollessly and hardwarelessly secures a ground conductor thereto.

The foregoing objectives are basically attained by a grounding electrical connector including a base member and first and second legs extending outwardly from the base member. A first recess is defined by the first and second legs for receiving a support. Second recesses extend inwardly from second sides of the first and second legs. A plurality of pairs of oppositely disposed grooves are formed in the second recesses. At least two pairs of the oppositely disposed grooves have different sizes for receiving various conductor sizes.

The foregoing objectives are also basically attained by an electrical connecting including a grounding electrical connector having a base member and first and second legs extending outwardly from the base member. First recesses extend inwardly from first sides of the first and second legs. The first recesses are connectable to a support. First pairs of upper and lower flexible tabs extend outwardly from upper and lower sides of the first recesses in the first and second legs and toward one another. Second recesses extend inwardly from second sides of the first and second legs. Second pairs of upper and lower flexible tabs extend outwardly from upper and lower sides of the second recesses in the first and second legs and toward one another. A plurality of oppositely disposed grooves are formed in free ends of the second pairs of upper and lower flexible tabs. At least two pairs of the oppositely disposed grooves have different sizes for receiving various conductor sizes. A channel member is connected to the base member and has a channel extending between each pair of oppositely disposed grooves to facilitate receiving a conductor.

Objects, advantages, and salient features of the invention will become apparent from the following detailed description, which, taken in conjunction with the annexed drawings, discloses exemplary embodiments of the present invention.

As used in this application, the terms "front," "rear," "upper," "lower," "upwardly," "downwardly," and other orientational descriptors are intended to facilitate the description of the exemplary embodiments of the present invention, and are not intended to limit the structure thereof to any particular position or orientation.

BRIEF DESCRIPTION OF THE DRAWINGS

The above benefits and other advantages of the various embodiments of the present invention will be more apparent from the following detailed description of exemplary embodiments of the present invention and from the accompanying drawing figures, in which:

FIG. 2 is a side elevational view of the electrical connector of FIG. 1;

FIG. 3 is a rear elevational view of the electrical connector assembly of FIG. 1;

FIG. 4 is a front elevational view of the electrical connector of FIG. 1;

Throughout the drawings, like reference numerals will be understood to refer to like parts, components and structures.

DETAILED DESCRIPTION OF EXEMPLARY EMBODIMENTS

Figure 1:
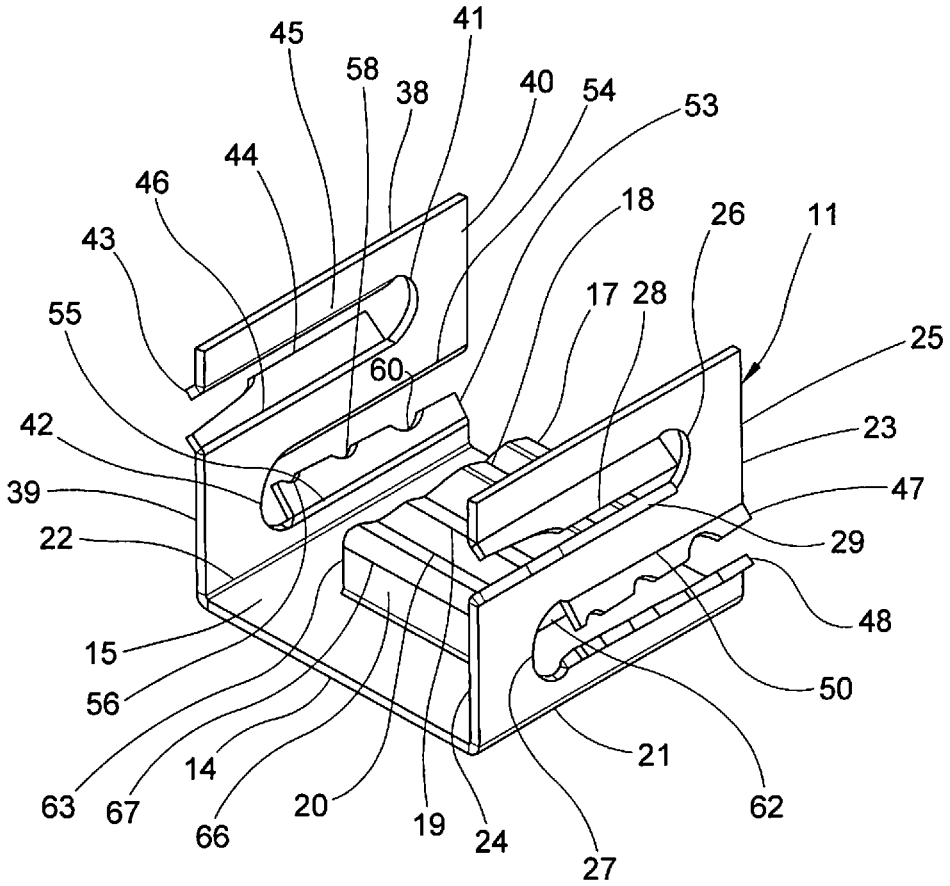
FIG. 1 is a perspective view of a grounding electrical connector in accordance with a first exemplary embodiment of the present invention.
Figure 65:
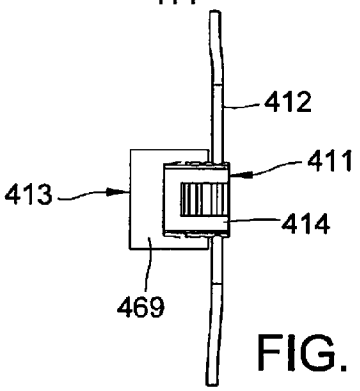
FIG. 65 is a bottom plan view of the electrical connector connected to the support of FIG. 59.
Figure 62:
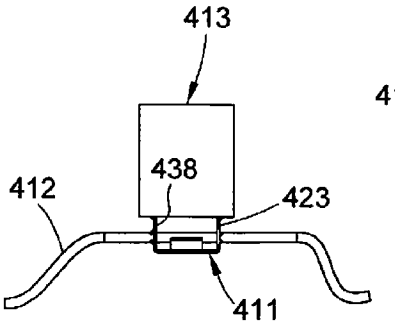
FIG. 62 is a rear elevational view of the electrical connector connected to the support of FIG. 59.

A grounding electrical connector in accordance with exemplary embodiments of the present invention is shown in FIGS. 1-65. The electrical connector is preferably unitarily formed as a single member and is made of a conductive material. The electrical connector is adapted to receive various conductor sizes and to be connected to supports having varying thicknesses.

A grounding electrical connector 11 in accordance with a first exemplary embodiment of the present invention connects a ground conductor 12 to a support 13, as shown in FIGS. 7-11. For example, the electrical connector can be used to connect an equipment ground conductor to a solar photovoltaic (PV) module frame or module mounting structure.

Figure 5:
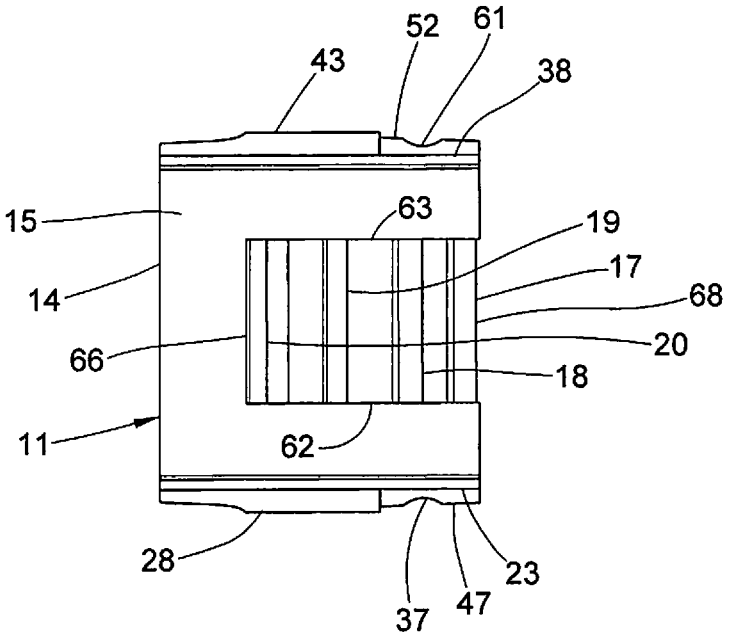
FIG. 5 is a top plan view of the electrical connector of FIG. 1.
Figure 6:
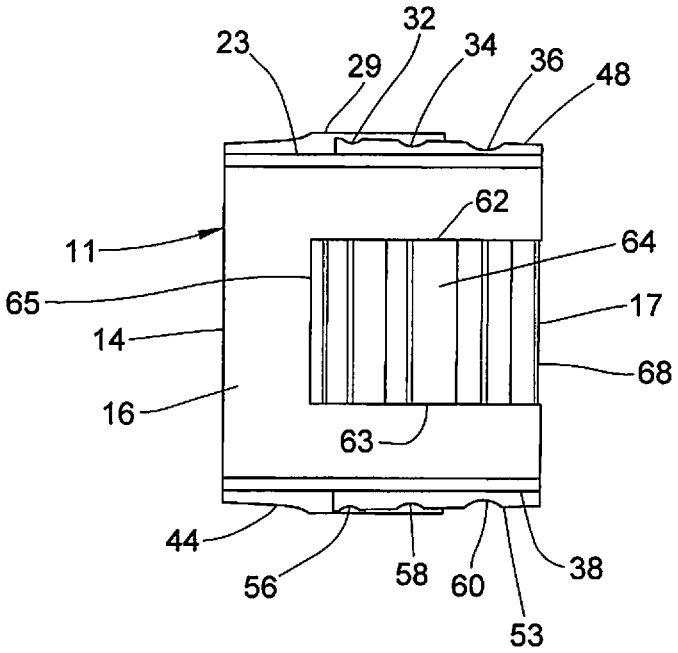
FIG. 6 is a bottom plan view of the electrical connector of FIG. 1.

The electrical connector 11 includes a base member 14, as shown in FIGS. 1-6, and has an upper surface 15 and a lower surface 16. A resilient channel member 17 is connected to the upper surface 15 of the base member and has a plurality of channels 18 extending between first and second opposite sides 21 and 22 of the base member 14. As shown in FIGS. 1 and 5, the channel member 17 has three channels 18, 19 and 20, although the channel member may have any suitable number of channels. The channel member 17 preferably does not extend the entire length of the upper surface 15 between the first and second sides 21 and 22, as shown in FIG. 1. As shown in FIGS. 1, 3 and 4, the electrical connector 11 is preferably substantially U-shaped.

A first leg 23 extends outwardly from the first side 21 of the base member 14. Preferably the first leg 23 is substantially perpendicular to the base member 14, as shown in FIGS. 3 and 4. The first leg 23 has first and second opposite sides 24 and 25. A first recess 26 extends inwardly from the first side 24 of the first leg 23. A second recess 27 extends inwardly from the second side 25 of the first leg 23. The second recess 27 is preferably disposed between the first recess 26 and the base member 14.

Upper and lower flexible tabs 28 and 29 extend outwardly and toward one another from opposite sides 30 and 31 of the first recess 26, as shown in FIGS. 1 and 2. The distance between the free ends of the flexible tabs 28 and 29 decreases inwardly in a direction away from the first side 21 to facilitate receiving the support 13 therein.

Upper and lower flexible tabs 47 and 48 extend outwardly and toward one another from opposite sides 50 and 51 of the second recess 27, as shown in FIGS. 1 and 2. The distance between the free ends of the flexible tabs 47 and 48 decreases inwardly to facilitate receiving the support 13 therein.

A plurality of pairs of grooves are formed in the free ends of the flexible tabs 47 and 48, as shown in FIGS. 1 and 2, to facilitate receiving the conductor 12 therebetween. A first pair of grooves 32 and 33 is disposed proximal the closed end of the second recess 27. A second pair of grooves 34 and 35 is disposed adjacent the first pair of grooves 32 and 33. A third pair of grooves 36 and 37 is disposed proximal the open end of the second recess 27. The groove sizes are different to facilitate receiving different conductor sizes. As shown in FIG. 2, the grooves increase in size from the first pair to the third pair. For example, the first pair of grooves 32 and 33 is sized to receive a 10 AWG conductor, the second pair of grooves 34 and 35 is sized to receive an 8 AWG conductor, and the third pair of grooves 36 and 37 is sized to receive a 6 AWG conductor. Accordingly, the different groove sizes facilitates receiving different conductor sizes. Any suitable combination and orientation of grooves can be used based on conductor sizes to be received by the grounding electrical connector 11.

A second leg 38 is substantially similar to the first leg 23 and extends outwardly from the second side 22 of the base member 14. Preferably the second leg 38 is substantially perpendicular to the base member 14, as shown in FIGS. 3 and 4. The second leg 38 has first and second opposite sides 39 and 40. A first recess 41 extends inwardly from the first side 39 of the second leg 38, and is aligned with the first recess 26 in the first leg 23. A second recess 42 extends inwardly from the second side 40 of the second leg 38, and is aligned with the second recess 27 in the first leg 23. The second recess 42 is preferably disposed between the first recess 41 of the second leg 38 and the base member 14.

Upper and lower flexible tabs 43 and 44 extend outwardly and toward one another from opposite sides 45 and 46 of the first recess 41, as shown in FIG. 1. The distance between the free ends of the flexible tabs 43 and 44 decreases inwardly to facilitate receiving the support 13 therein.

Upper and lower flexible tabs 52 and 53 extend outwardly and toward one another from opposite sides 54 and 55 of the second recess 42, as shown in FIG. 1. The distance between the free ends of the flexible tabs 43 and 44 decreases inwardly to facilitate receiving the support 13 therein.

Figure 11:
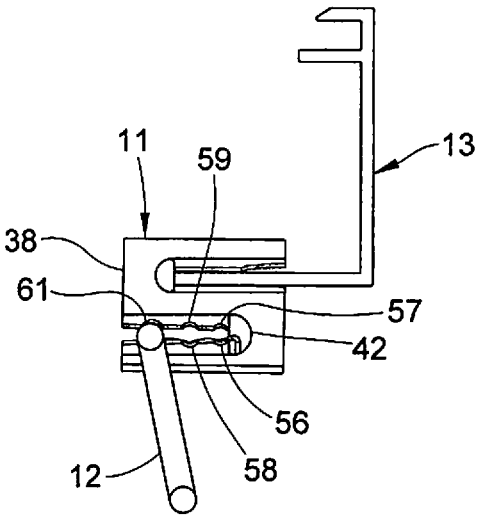
FIG. 11 is a rear elevational view of the electrical connector connected to the support of FIG. 7.

A plurality of pairs of grooves are formed in the free ends of the flexible tabs 52 and 53, as shown in FIGS. 1 and 11, to facilitate receiving the conductor 12 therebetween. A first pair of grooves 56 and 57 is disposed proximal the closed end of the second recess 42. A second pair of grooves 58 and 59 is disposed adjacent the first pair of grooves 56 and 57. A third pair of grooves 60 and 61 is disposed proximal the open end of the second recess 42. The groove sizes are different to facilitate receiving different conductor sizes. As shown in FIG. 11, the grooves increase in size from the first pair to the third pair. For example, the first pair of grooves 56 and 57 is sized to receive a 10 AWG conductor, the second pair of grooves 58 and 59 is sized to receive an 8 AWG conductor, and the third pair of grooves 60 and 61 is sized to receive a 6 AWG conductor. Accordingly, the different groove sizes facilitate receiving different conductor sizes. Any suitable combination and orientation of grooves can be used based on conductor sizes to be received by the grounding electrical connector 11.

Figure 7:
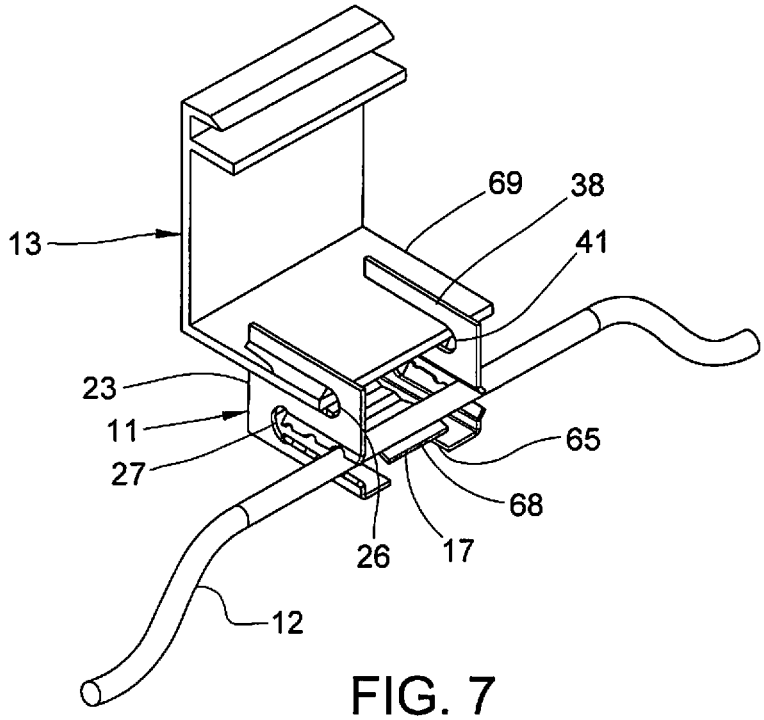
FIG. 7 is an upper perspective view of the electrical connector of FIG. 1 connected to a support and receiving a conductor.
Figure 8:
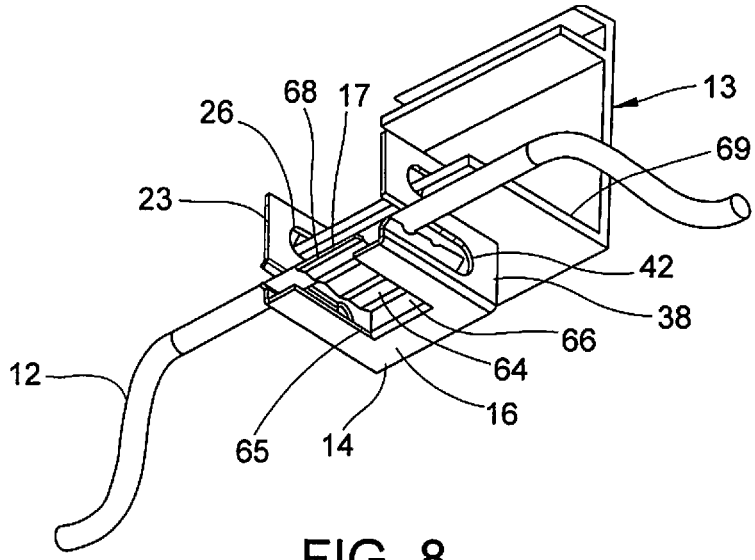
FIG. 8 is a lower perspective view of the electrical connector connected to the support of FIG. 7.
Figure 9:
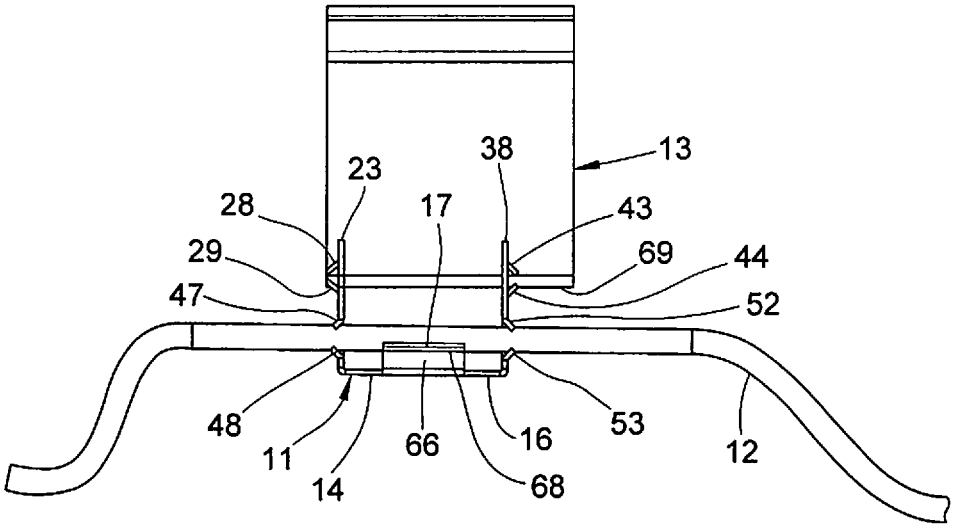
FIG. 9 is a side elevational view of the electrical connector connected to the support of FIG. 7.

The channel member 17 is connected to an upper surface 15 of the base member 14, as shown in FIGS. 1 and 3-5. Preferably, a rear wall 66 connects the channel member 17 to the base member 14, thereby providing flexibility to the channel member 17 such that the channel member 17 extends from a fixed end 67 connected to the rear wall to a free end 68 spaced from the rear wall 66. The channels 18, 19 and 20 extend from a first side 62 to a second side 63 of the channel member 17, as shown in FIG. 1. Preferably, the first side 62 is spaced inwardly from the first leg 23 and the second side 63 is spaced inwardly from the second leg 38, as shown in FIGS. 3 and 4. A lower surface 64 of the channel member 17 is spaced upwardly from the base member 14, as shown in FIGS. 7 and 8. A recess 65 is formed in the base member 14 corresponding to the channel member 17. The free front end 66 of the channel member 17 is resilient such that various diameter conductors can be quickly and easily inserted in the second recesses 27 and 42 of the first and second legs 23 and 38 and securely held therein by the flexible tabs pressing against the inserted conductor.

The grounding electrical connector 11 is preferably unitarily formed as a single member and is made of a conductive material, such as stainless steel. The grounding electrical connector 11 can be stamped out of a single piece of conductive material.

Assembly and Operation

As shown in FIGS. 7-11, an electrical connector 11 in accordance with an exemplary embodiment of the present invention is connected to the support 13, such as a solar PV module frame or module mounting structure. The electrical connector 11 receives the conductor 12, such as an equipment ground conductor, to mechanically and electrically connect the conductor 12 to the support 13.

The first recesses 26 and 41 in the first and second legs 23 and 38 receive a substantially planar member 69 of the support 13. The decreased distance between the first ends of the flexible tabs 28 and 29 of the first leg 23 and the flexible tabs 43 and 44 of the second leg 38 facilitate inserting the planar member 69 in the first recesses 26 and 41. The flexible tabs extend toward one another such that movement of the electrical connector 11 causes the flexible tabs to tighten their grip on the planar member 69. The flexibility of the tabs facilitates connecting the electrical connector 11 to supports having various thicknesses.

The second recesses 27 and 42 in the first and second legs 23 and 38 receive the conductor 12. The decreased distance between the first ends of the flexible tabs 47 and 48 of the first leg 23 and the flexible tabs 52 and 53 of the second leg 38 facilitate inserting the conductor 12 in the second recesses 27 and 42. The flexible tabs extend toward one another such that movement of the conductor 12 causes the flexible tabs to tighten their grip on the conductor 13.

Figure 10:
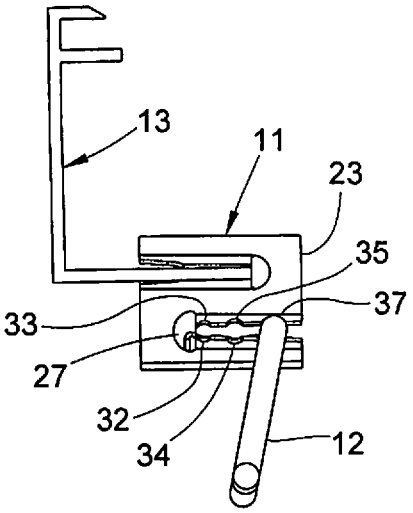
FIG. 10 is a front elevational view of the electrical connector connected to the support of FIG. 7.

The oppositely disposed pairs of grooves in the flexible tabs of the second recesses 27 and 42 have different sizes to accommodate various conductor sizes. As shown in FIGS. 10 and 11, three pairs of grooves are shown sized to receive 6, 8 and 10 AWG conductors. The channels 18, 19 and 20 in the channel member 17 have sizes corresponding to the pair of grooves between which the channels extend, thereby facilitating receiving the conductor 12. The free end 68 of the channel member 17 facilitates flexing of the channel member 17 to more easily receive the inserted conductor 12 and to increase conductive surface area contact between the conductor 12 and the connector 11.

Second Exemplary Embodiment

A grounding electrical connector 111 in accordance with a second exemplary embodiment of the present invention is shown in FIGS. 12-17. The electrical connector 111 is shown connected to a support 113 and receiving a ground conductor 112 in FIGS. 18-24. The electrical connector 111 is substantially similar to the electrical connector 11 of the first exemplary embodiment shown in FIGS. 1-11. Similar features are indicated with the same reference numeral, except in the 100 series, e.g., 1xx.

The electrical connector 111 includes third and fourth legs 171 and 172 that extend inwardly from ends of the first and second legs 123 and 138, as shown in FIGS. 12-17. The third and fourth legs 171 and 172 are substantially planar to the base member 114 from which the first and second legs 123 and 138 extend, respectively. The third and fourth legs 171 and 172 are preferably substantially perpendicular to the first and second legs 123 and 138.

Figure 13:
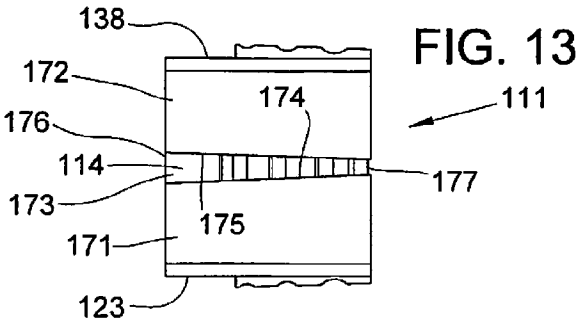
FIG. 13 is a top plan view of the electrical connector of FIG. 12.
Figure 16:
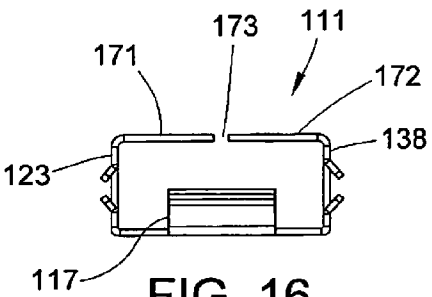
FIG. 16 is a front elevational view of the electrical connector of FIG. 12.
Figure 15:
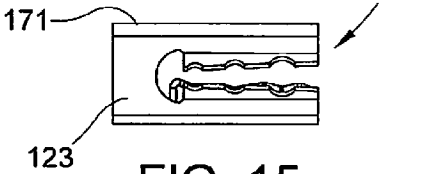
FIG. 15 is a side elevational view of the electrical connector of FIG. 12.
Figure 17:
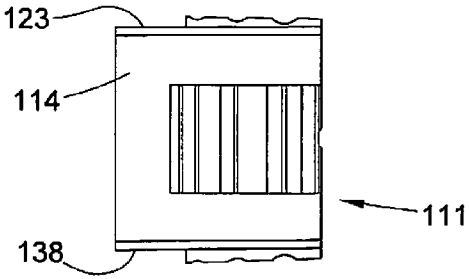
FIG. 17 is a bottom plan view of the electrical connector of FIG. 12.
Figure 14:
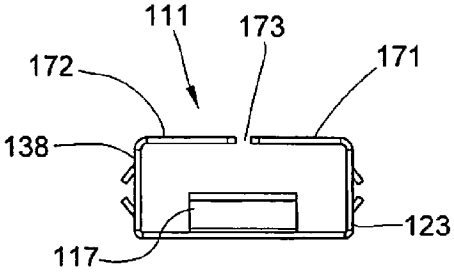
FIG. 14 is a rear elevational view of the electrical connector of FIG. 12.
Figure 12:
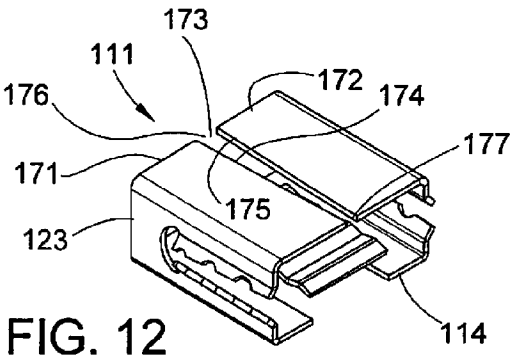
FIG. 12 is a perspective view of a grounding electrical connector in accordance with a second exemplary embodiment of the present invention.
Figures 18, 19, 20, 21, 22, 23, 24:
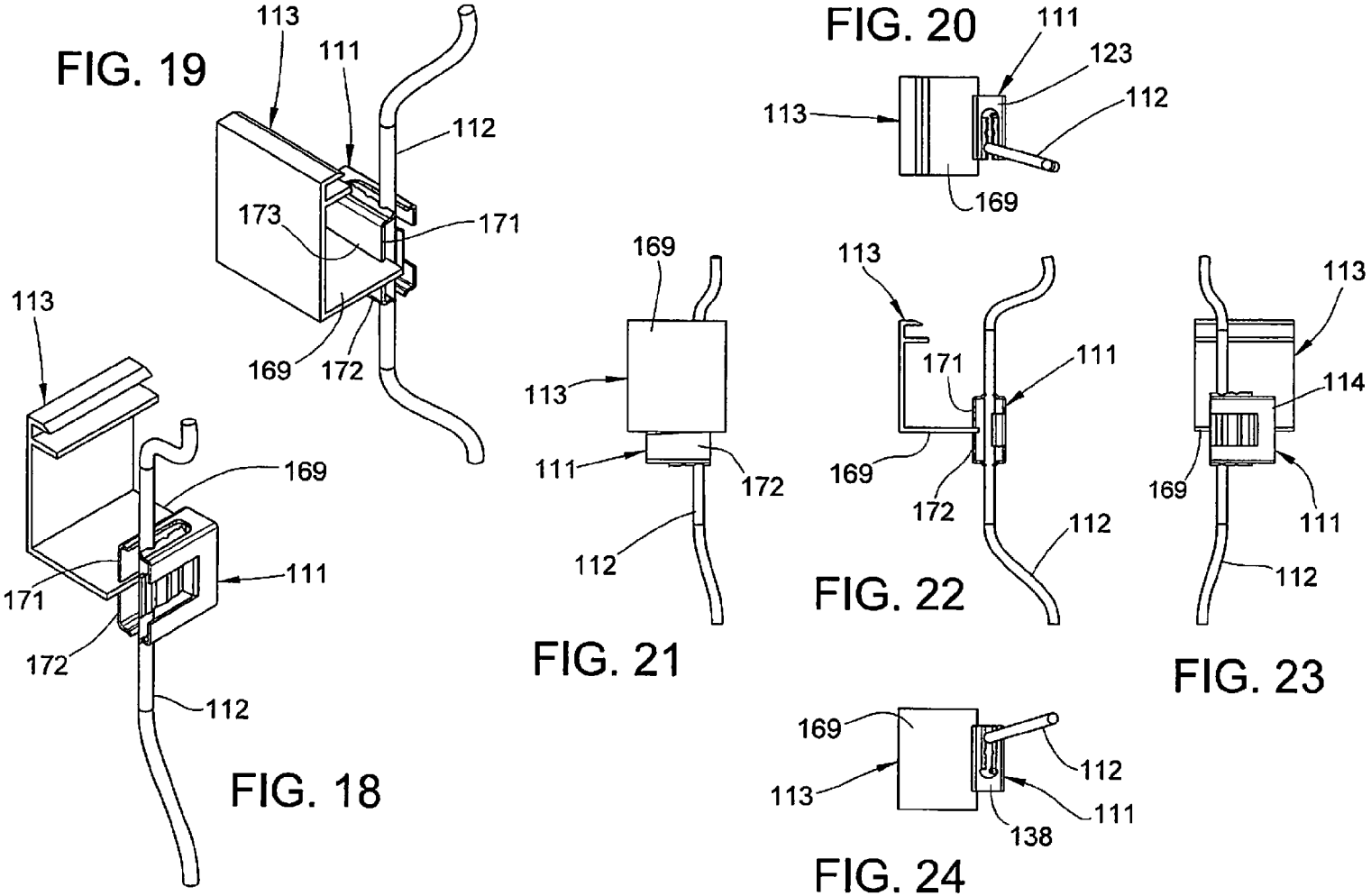
FIG. 18 is a front perspective view of the electrical connector of FIG. 12 connected to a support and receiving a conductor.
FIG. 19 is a rear perspective view of the electrical connector connected to the support of FIG. 18.
FIG. 20 is a top plan view of the electrical connector connected to the support of FIG. 18.
FIG. 21 is a rear elevational view of the electrical connector connected to the support of FIG. 18.
FIG. 22 is a side elevational view of the electrical connector connected to the support of FIG. 18.
FIG. 23 is a front elevational view of the electrical connector connected to the support of FIG. 18.
FIG. 24 is a bottom plan view of the electrical connector connected to the support of FIG. 18.

A recess or gap 173 is formed between free ends 174 and 175 of the third and fourth legs 171 and 172, as shown in FIGS. 12 and 13. The gap 173 tapers or narrows from a first end 176 to a second end 177 of the gap. The gap 173 receives the substantially planar member 169 of the support 113, as shown in FIGS. 18-24. Inserting the planar member 169 of the support 113 in the gap 173 between the third and fourth legs 171 and 172 of the electrical connector 111 causes the conductor 112 to be more tightly gripped.

Third Exemplary Embodiment

A grounding electrical connector 211 in accordance with a third exemplary embodiment of the present invention is shown in FIGS. 25-30. The electrical connector 211 is shown connected to a support 213 and receiving a ground conductor 212 in FIGS. 31-37. The electrical connector 211 is substantially similar to the electrical connector 11 of the first exemplary embodiment shown in FIGS. 1-11. Similar features are indicated with the same reference numeral, except in the 200 series, e.g., 2xx.

Figures 25, 26, 27, 28, 29, 30:
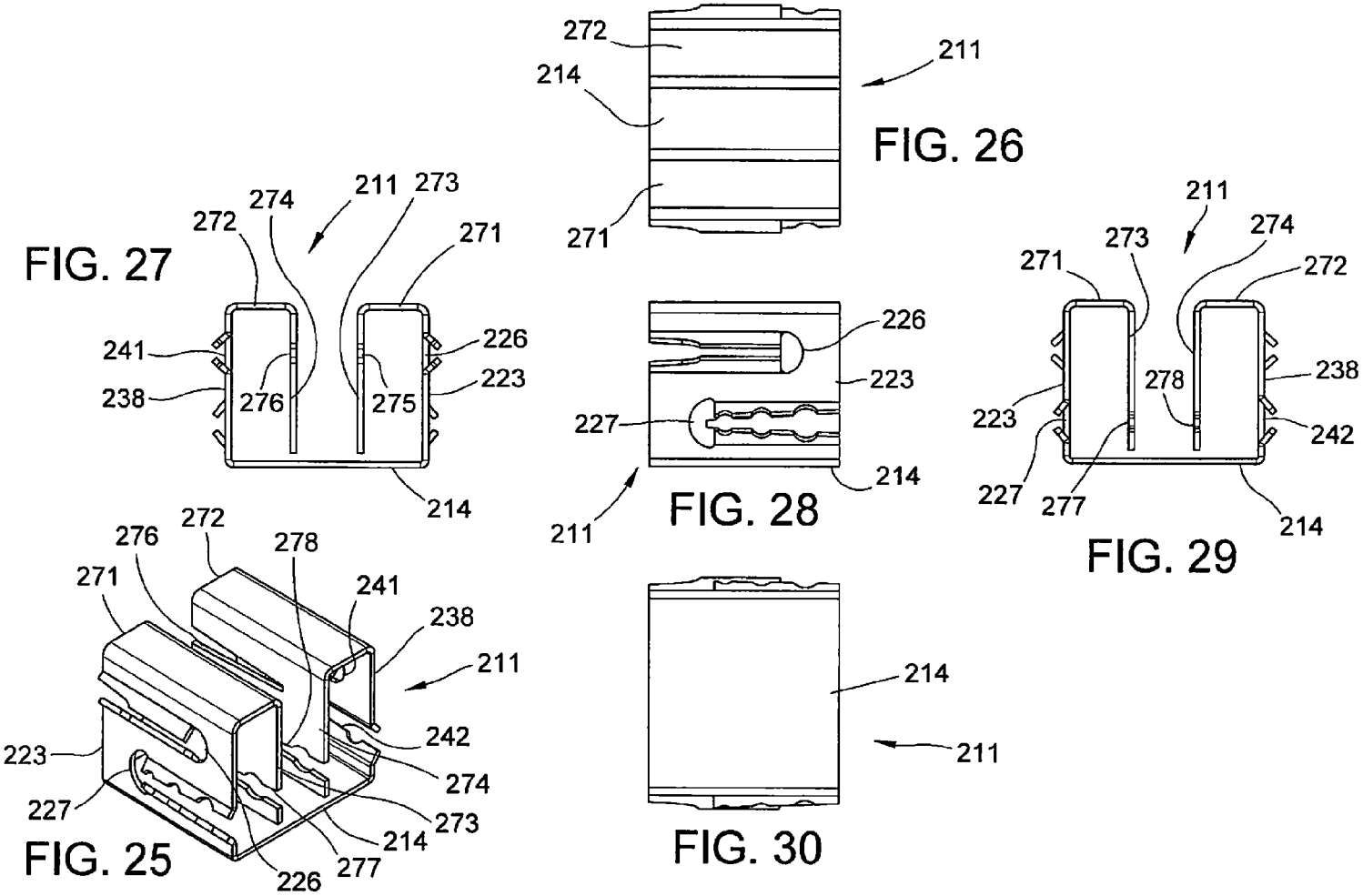
FIG. 25 is a perspective view of a grounding electrical connector in accordance with a third exemplary embodiment of the present invention.
FIG. 26 is a top plan view of the electrical connector of FIG. 25.
FIG. 27 is a rear elevational view of the electrical connector of FIG. 25.
FIG. 28 is a side elevational view of the electrical connector of FIG. 25.
FIG. 29 is a front elevational view of the electrical connector of FIG. 25.
FIG. 30 is a bottom plan view of the electrical connector of FIG. 25.
Figure 31:
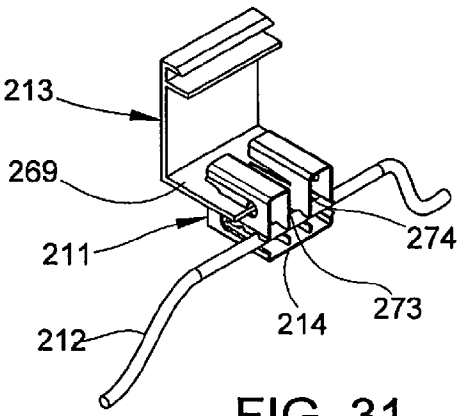
FIG. 31 is a front perspective view of the electrical connector of FIG. 25 connected to a support and receiving a conductor.
Figure 32:
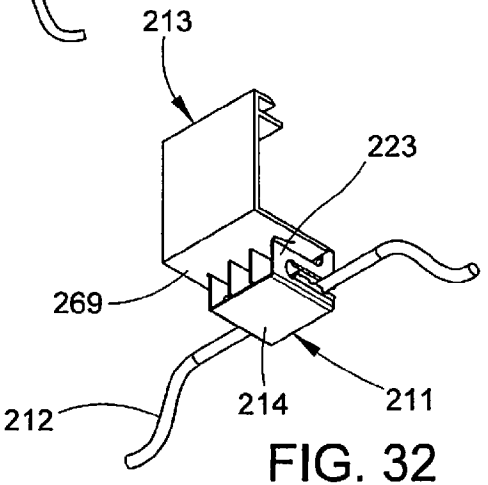
FIG. 32 is a rear perspective view of the electrical connector connected to the support of FIG. 31.
Figure 33:
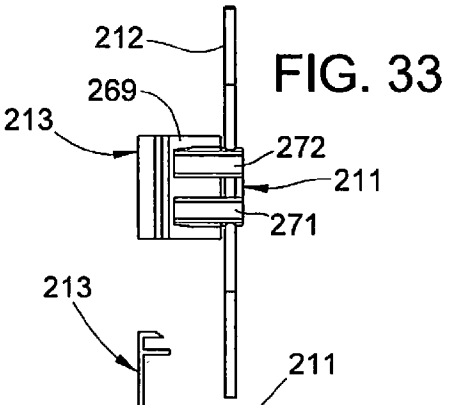
FIG. 33 is a top plan view of the electrical connector connected to the support of FIG. 31.
Figure 36:
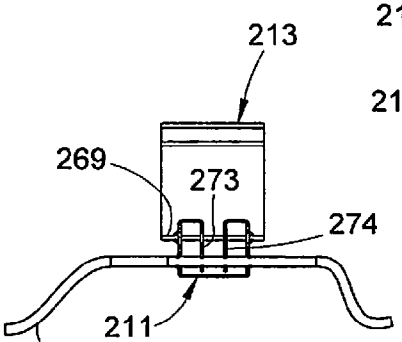
FIG. 36 is a front elevational view of the electrical connector connected to the support of FIG. 31.
Figure 35:
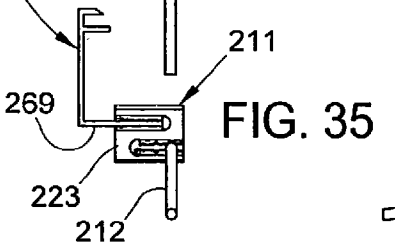
FIG. 35 is a side elevational view of the electrical connector connected to the support of FIG. 31.
Figure 37:
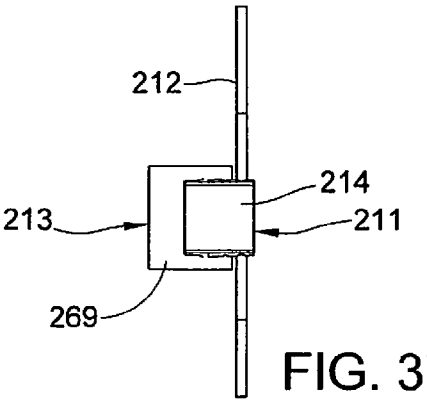
FIG. 37 is a bottom plan view of the electrical connector connected to the support of FIG. 31.
Figure 34:
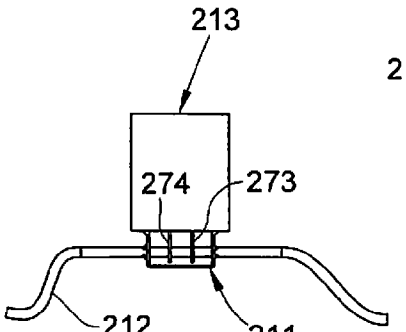
FIG. 34 is a rear elevational view of the electrical connector connected to the support of FIG. 31.
Figures 38, 39, 40, 41, 42, 43, 44:
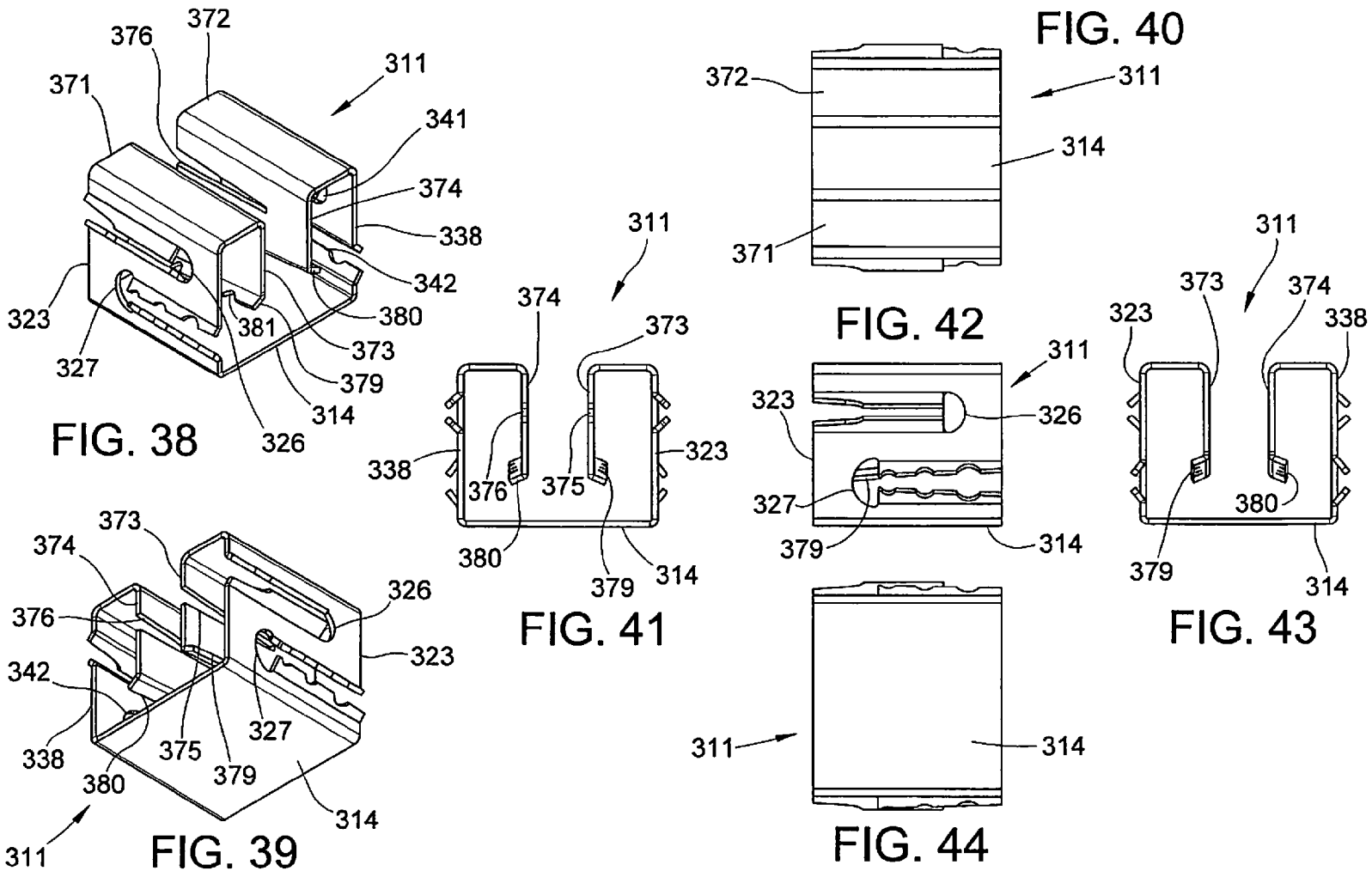
FIG. 38 is an upper perspective view of a grounding electrical connector in accordance with a fourth exemplary embodiment of the present invention.
FIG. 39 is a lower perspective view of the electrical connector of FIG. 38.
FIG. 40 is a top plan view of the electrical connector of FIG. 38.
FIG. 41 is a rear elevational view of the electrical connector of FIG. 38.
FIG. 42 is a side elevational view of the electrical connector of FIG. 38.
FIG. 43 is a front elevational view of the electrical connector of FIG. 38.
FIG. 44 is a bottom plan view of the electrical connector of FIG. 38.
Figure 45:
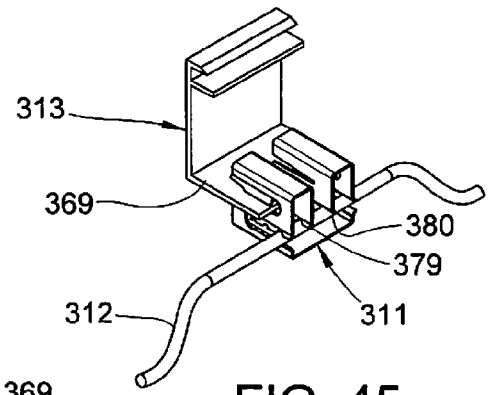
FIG. 45 is a front perspective view of the electrical connector of FIG. 38 connected to a support and receiving a conductor.
Figure 46:
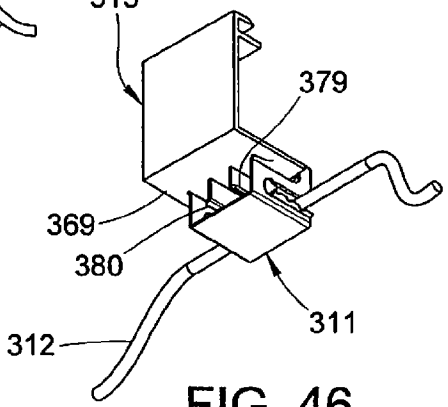
FIG. 46 is a rear perspective view of the electrical connector connected to the support of FIG. 45.
Figure 47:
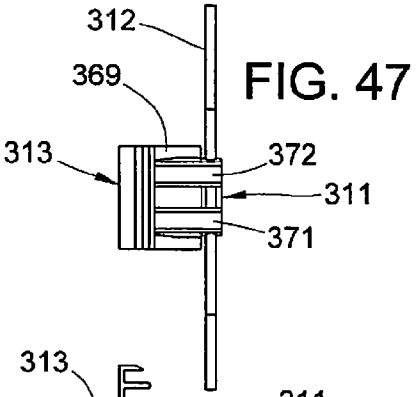
FIG. 47 is a top plan view of the electrical connector connected to the support of FIG. 45.
Figure 48:
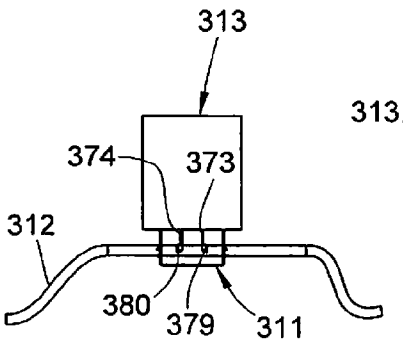
FIG. 48 is a rear elevational view of the electrical connector connected to the support of FIG. 45.
Figure 49:
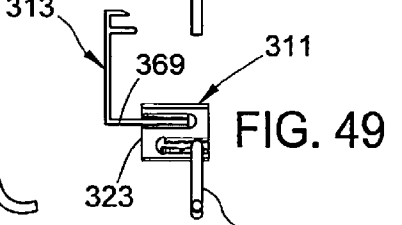
FIG. 49 is a side elevational view of the electrical connector connected to the support of FIG. 45.
Figure 50:
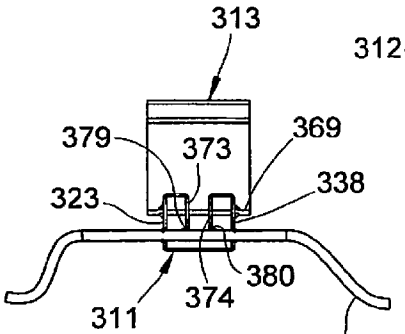
FIG. 50 is a front elevational view of the electrical connector connected to the support of FIG. 45.
Figure 51:
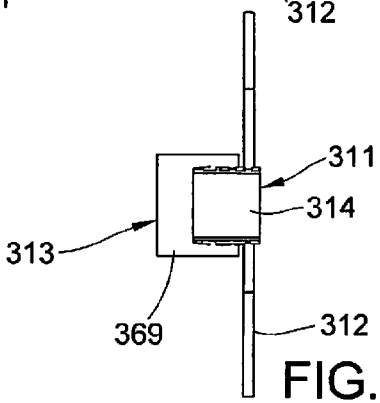
FIG. 51 is a bottom plan view of the electrical connector connected to the support of FIG. 45.

The electrical connector 211 includes third and fourth legs 271 and 272 that extend inwardly from ends of the first and second legs 223 and 238, as shown in FIGS. 25, 27 and 29. The third and fourth legs 271 and 272 are substantially planar to the base member 214 from which the first and second legs 223 and 238 extend, respectively. The third and fourth legs 271 and 272 are preferably substantially perpendicular to the first and second legs 223 and 238.

Fifth and sixth legs 273 and 274 extend downwardly toward the base member 214 from the third and fourth legs 271 and 272, as shown in FIGS. 25, 27 and 29. The fifth and sixth legs 273 and 274 are preferably substantially parallel to the first and second legs 223 and 238.

Upper openings 275 and 276 in the fifth and sixth legs 273 and 274 are aligned with the openings 226 and 241 in the first and second legs 223 and 238 to receive the substantially planar member 269 of the support 213, as shown in FIGS. 31-37. The upper openings 275 and 276 extend forwardly from a rear end of the fifth and sixth legs 273 and 274.

Lower openings 277 and 278 in the fifth and sixth legs 273 and 274 are aligned with the openings 227 and 242 in the first and second legs 223 and 238 to receive the conductor 212, as shown in FIGS. 31-37. The lower openings 277 and 278 extend rearwardly from a front end of the fifth and sixth legs 273 and 274. A plurality of grooves are formed in the lower openings 277 and 278 that correspond to the grooves formed in the openings 227 and 242 to accommodate various conductor sizes. Accordingly, each of the grooves in the lower openings 277 and 278 is a different size.

As shown in FIG. 30, the base member 214 is preferably a substantially planar and continuous member. The lower openings 277 and 278 in the fifth and sixth legs 273 and 274 support the conductor 212 such that a channel member 17 (FIG. 1) is not required. The free ends of the fifth and sixth legs 273 and 274 are preferably spaced above the base member 214, as shown in FIGS. 27 and 29. The fifth and sixth legs 273 and 274 provide additional openings to receive the planar support member 269 and the conductor 212, thereby improving the retention and electrical connection of the grounding electrical connector 211.

Fourth Exemplary Embodiment

A grounding electrical connector 311 in accordance with a fourth exemplary embodiment of the present invention is shown in FIGS. 38-44. The electrical connector 311 is shown connected to a support 313 and receiving a ground conductor 312 in FIGS. 45-51. The electrical connector 311 is substantially similar to the electrical connector 211 of the third exemplary embodiment shown in FIGS. 25-37. Similar features are indicated with the same reference numeral, except in the 300 series, e.g., 3xx.

Tabs 379 and 380 extend from free ends of the fifth and sixth legs 373 and 374 toward the first and second legs 323 and 338, respectively, as shown in FIGS. 38, 39, 41 and 43. A plurality of grooves 381 are formed in the free ends of the fifth and sixth legs 373 and 374, corresponding to the grooves in the openings 327 and 342 in the first and second legs 323 and 338, to facilitate receiving different diameter conductors. The tabs 379 and 380 facilitate retaining the conductor 312 and creating an electrical connection thereto.

Fifth Exemplary Embodiment

A grounding electrical connector 411 in accordance with a fifth exemplary embodiment of the present invention is shown in FIGS. 52-58. The electrical connector 411 is shown connected to a support 413 and receiving a ground conductor 412 in FIGS. 59-65. The electrical connector 411 is substantially similar to the electrical connector 11 of the first exemplary embodiment shown in FIGS. 1-11. Similar features are indicated with the same reference numeral, except in the 400 series, e.g., 4xx.

Figure 52:
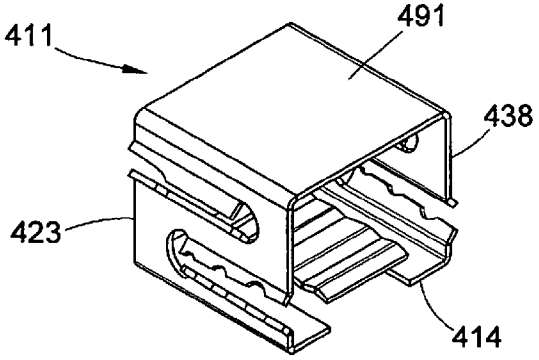
FIG. 52 is an upper perspective view of a grounding electrical connector in accordance with a fifth exemplary embodiment of the present invention.
Figure 53:
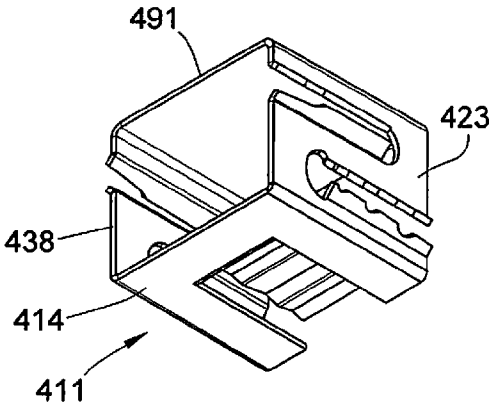
FIG. 53 is a lower perspective view of the grounding electrical connector of FIG. 52.
Figure 54:
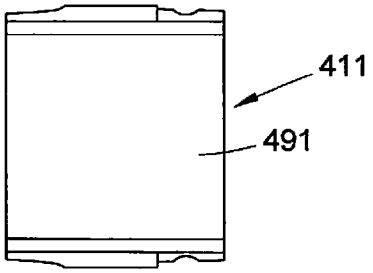
FIG. 54 is a top plan view of the electrical connector of FIG. 52.
Figure 57:
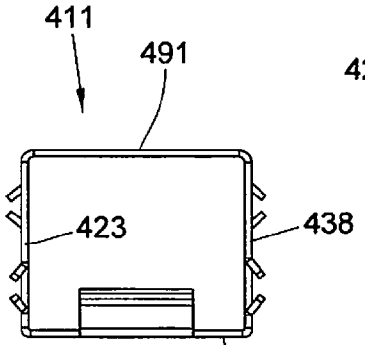
FIG. 57 is a front elevational view of the electrical connector of FIG. 52.
Figure 56:
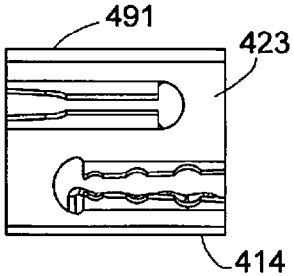
FIG. 56 is a side elevational view of the electrical connector of FIG. 52.
Figure 58:
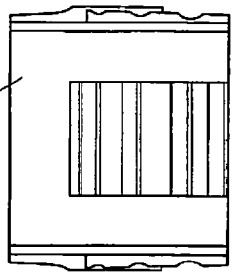
FIG. 58 is a bottom plan view of the electrical connector of FIG. 52.
Figure 55:
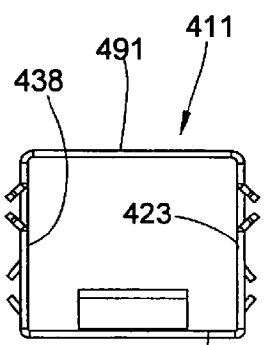
FIG. 55 is a rear elevational view of the electrical connector of FIG. 52.
Figure 59:
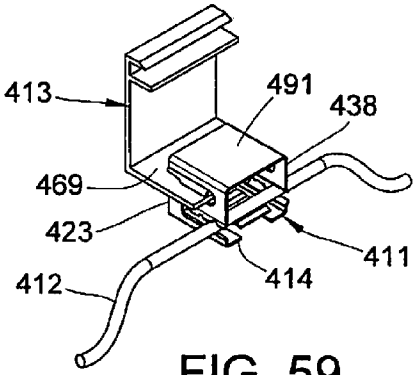
FIG. 59 is a front perspective view of the electrical connector of FIG. 52 connected to a support and receiving a conductor.
Figure 60:
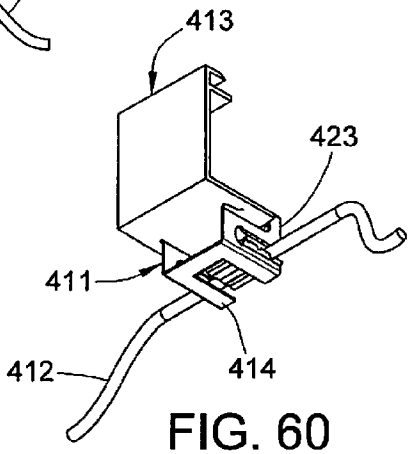
FIG. 60 is a rear perspective view of the electrical connector connected to the support of FIG. 59.
Figure 61:
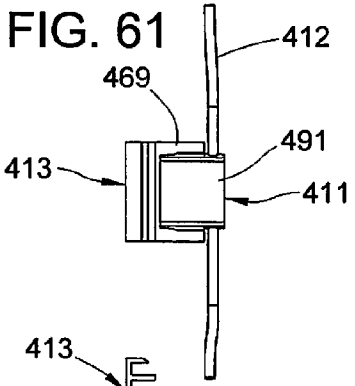
FIG. 61 is a top plan view of the electrical connector connected to the support of FIG. 59.
Figure 63:
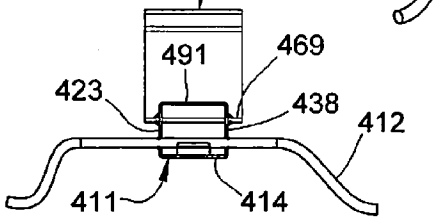
FIG. 63 is a side elevational view of the electrical connector connected to the support of FIG. 59.
Figure 64:
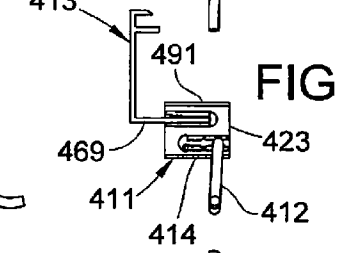
FIG. 64 is a front elevational view of the electrical connector connected to the support of FIG. 59.

The electrical connector 411 is preferably made from a rectangular tube. The electrical connector 411 has an upper planar member 491 substantially parallel to the base member 414, as shown in FIGS. 52, 55 and 57. The upper planar member 491 extends between the first and second legs 323 and 338. Manufacturing the electrical connector 411 from a tube provides rigidity to the resulting electrical connector, in addition to providing manufacturing options.

The foregoing embodiments and advantages are merely exemplary and are not to be construed as limiting the scope of the present invention. The description of exemplary embodiments of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. An electrical connector, comprising:

a base member;

first and second legs extending outwardly from said base member;

a first recess defined by said first and second legs for receiving a support;

second recesses extending inwardly from second sides of said first and second legs; and a plurality of oppositely disposed grooves formed in said second recesses, at least two pairs of said oppositely disposed grooves having different sizes for receiving various conductor sizes.

2. The electrical connector according to claim 1, wherein said first recess includes first recesses extending inwardly from first sides of said first and second legs.

3. The electrical connector according to claim 1, wherein said first and second legs extend substantially perpendicularly from said base member.

4. The electrical connector according to claim 1, wherein said first sides of said first and second legs are opposite said second sides of said first and second legs.

5. The electrical connector according to claim 1, wherein said electrical connector is unitarily formed as a single piece.

6. The electrical connector according to claim 1, wherein a channel member is connected to said base member and a channel extends between each pair of said oppositely disposed grooves to facilitate receiving the conductor.

7. The electrical connector according to claim 6, wherein said channel member has a fixed end connected to said base member and a free end.

8. The electrical connector according to claim 1, wherein each of said second recesses has upper and lower flexible tabs extending outwardly from said respective leg and toward one another.

9. The electrical connector according to claim 8, wherein said plurality of grooves are formed in free ends of said upper and lower flexible tabs of said second recesses.

10. The electrical connector according to claim 1, wherein each of said first recesses has upper and lower flexible tabs extending outwardly from said respective leg and toward one another.

11. The electrical connector according to claim 10, wherein a distance between free ends of said upper and lower flexible tabs of said first recesses of said first and second legs decreases toward a closed end of said second recesses.

12. The electrical connector according to claim 8, wherein a distance between free ends of said upper and lower flexible tabs of said second recesses of said first and second legs decreases toward a closed end of said first recesses.

13. The electrical connector according to claim 6, wherein each of said channels has a size corresponding to said oppositely disposed grooves between which said channel extends.

14. The electrical connector according to claim 10, wherein said second recesses are disposed between said first recesses and said base member.

15. The electrical connector according to claim 1, wherein sides of said channel member are spaced inwardly from said first and second legs.

16. An electrical connector, comprising:

a base member;

first and second legs extending outwardly from said base member;

first recesses extending inwardly from first sides of said first and second legs, said first recesses being connectable to a support;

first pairs of upper and lower flexible tabs extending outwardly from upper and lower sides of said first recesses in said first and second legs and toward one another;

second recesses extending inwardly from second sides of said first and second legs;

second pairs of upper and lower flexible tabs extending outwardly from upper and lower sides of said second recesses in said first and second legs and toward one another;

a plurality of oppositely disposed grooves formed in free ends of said second pairs of upper and lower flexible tabs, at least two pairs of said oppositely disposed grooves having different sizes for receiving various conductor sizes; and a channel member connected to said base member and having a channel extending between each pair of oppositely disposed grooves to facilitate receiving a conductor.

17. The electrical connector according to claim 16, wherein said electrical connector is unitarily formed as a single piece.

18. The electrical connector according to claim 16, wherein said channel member has a fixed end connected to said base member and a free end.

19. The electrical connector according to claim 16, wherein said second recesses are disposed between said first recesses and said base member.

20. The electrical connector according to claim 16, wherein each of said channels has a size corresponding to said oppositely disposed grooves between which said channel extends.

* * * * *